US008756833B2

(12) United States Patent
Heard

(10) Patent No.: US 8,756,833 B2
(45) Date of Patent: Jun. 24, 2014

(54) LACING CLOSURE SYSTEM FOR AN OBJECT

(75) Inventor: Joshua P. Heard, Happy Valley, OR (US)

(73) Assignee: NIKE, Inc., Beaverton, OR (US)

( * ) Notice: Subject to any disclaimer, the term of this patent is extended or adjusted under 35 U.S.C. 154(b) by 737 days.

(21) Appl. No.: 12/985,882

(22) Filed: Jan. 6, 2011

(65) Prior Publication Data

US 2012/0174437 A1 Jul. 12, 2012

(51) Int. Cl.
*A43C 11/00* (2006.01)

(52) U.S. Cl.
USPC ..... 36/50.1; 36/51; 24/714.7

(58) Field of Classification Search
USPC ..... 36/50.1, 51; 24/714.7, 714.6
See application file for complete search history.

(56) References Cited

U.S. PATENT DOCUMENTS

| | | | | | |
|---|---|---|---|---|---|
| 36,497 | A | | 9/1862 | Whitmarsh | |
| 493,813 | A | | 3/1893 | Bertram | |
| 712,003 | A | * | 10/1902 | Payne | 24/714.7 |
| 777,973 | A | * | 12/1904 | Perlich | 24/581.1 |
| 923,860 | A | | 6/1909 | Kroell | |
| 1,670,468 | A | | 5/1928 | Martin et al. | |
| 2,004,702 | A | | 5/1934 | Luttmann, Jr. | |
| 2,292,770 | A | * | 8/1942 | Platkin | 36/7.2 |
| 2,369,254 | A | * | 2/1945 | Roman | 36/50.1 |
| 2,406,528 | A | * | 8/1946 | Blair | 450/141 |
| D163,019 | S | * | 4/1951 | Braun | D2/928 |
| D163,360 | S | * | 5/1951 | Braun | D2/935 |
| 3,456,366 | A | | 7/1969 | Boeing | |
| 4,192,018 | A | | 3/1980 | Latina | |
| 4,270,285 | A | | 6/1981 | Antonious | |
| 4,817,303 | A | | 4/1989 | Selbiger | |
| 4,974,299 | A | * | 12/1990 | Moon | 24/714.6 |
| 5,271,130 | A | | 12/1993 | Batra | |
| 5,416,987 | A | | 5/1995 | Bemis et al. | |
| 5,557,864 | A | | 9/1996 | Marks | |
| 6,128,835 | A | * | 10/2000 | Ritter et al. | 36/45 |
| 6,701,590 | B2 | | 3/2004 | Voughlohn | |
| 6,952,891 | B2 | * | 10/2005 | Hirayama | 36/50.5 |
| 7,073,279 | B2 | * | 7/2006 | Min | 36/50.1 |

* cited by examiner

*Primary Examiner* — Ted Kavanaugh
(74) *Attorney, Agent, or Firm* — Plumsea Law Group, LLC

(57) ABSTRACT

A closure system for an object having a first portion with first eyelets and a second portion with second eyelets includes a first lace that is resiliently flexible. The first lace is operable to extend continuously through the plurality of first eyelets and continuously through the plurality of second eyelets to define a first bridge portion and a second bridge portion of the first lace. The first bridge portion is defined between the plurality of first eyelets, and the second bridge portion is defined between the plurality of second eyelets. Additionally, the closure system includes a second lace that is substantially inelastic. The second lace engages both the first bridge portion and the second bridge portion to secure the first and second portions of the object together.

24 Claims, 2 Drawing Sheets

22
25
3
38
44
27
23
50
15
31
42
33
10
40
34
52
12
46
41
32
24
26
29
54
56
28
30

15
31
23
27
22
43
38
33
25
32
12
50
40
34
26
41
30
24
56
10
54
28
20
14
29
3

LACING CLOSURE SYSTEM FOR AN OBJECT

FIELD

The present disclosure relates to a closure system and, more particularly, relates to a lacing closure system for an object

BACKGROUND

Many objects include a lacing closure system. For instance, articles of footwear, sports equipment, and other objects include laces used for selectively closing and opening the object. More specifically, in the case of footwear, a first portion of the upper can include eyelets, and a separate second portion of the upper can include eyelets. Typically, a conventional shoelace is threaded through and extends successively between each of the eyelets. Ends of the shoelace can be pulled and tied together to cinch the first and second portions toward each other and to tightly secure the footwear to the wearer's foot. Other objects, such as footballs, bags, shirts, pants, etc. can include a similar lacing system.

Also, alternative closure systems can include straps, buckles, snaps, and the like. Like the lacing closure systems, these alternative systems can be operably coupled to two separate portions of the object, and the closure system allows the portions to be strapped, buckled, snapped, cinched or otherwise secured and retained together.

SUMMARY

Accordingly, despite the improvements of known devices described above, there remains a need for a closure system for an object having a first portion and a second portion that are separate from each other. The first portion includes a plurality of first eyelets, and the second portion including a plurality of second eyelets. The closure system includes a first lace that is resiliently flexible. The first lace is operable to extend continuously through the plurality of first eyelets and continuously through the plurality of second eyelets to define a first bridge portion and a second bridge portion of the first lace. The first bridge portion is defined between the plurality of first eyelets, and the second bridge portion is defined between the plurality of second eyelets. Furthermore, the closure system includes a second lace that is substantially inelastic. The second lace engages both the first bridge portion and the second bridge portion to secure the first and second portions of the object together.

Also, a closure system for an object having a first portion and a second portion that are separate from each other is disclosed. The first portion includes a plurality of first eyelets, and the second portion includes a plurality of second eyelets. The closure system includes a first lace operable to extend through the plurality of first eyelets and through the plurality of second eyelets to define a plurality of first bridge portions and a plurality of second bridge portions of the first lace. The plurality of first bridge portions is defined between respective ones of the plurality of first eyelets, and the plurality of second bridge portions is defined between respective ones of the plurality of second eyelets. The closure system also includes a second lace that continuously extends between and engages plural ones of the first bridge portions and plural ones of the second bridge portions to secure the first and second portions of the object together.

Moreover, an article of footwear is disclosed that includes an upper having a collar portion that extends about a wearer, a first eyelet portion including a plurality of eyelets, and a second eyelet portion including a plurality of second eyelets. The footwear also includes a first lace having a first terminal end and a second terminal end. The first and second terminal ends are each fixed to the collar portion. The first lace extends continuously through the plurality of first eyelets and continuously through the plurality of second eyelets to define a first bridge portion and a second bridge portion of the first lace. The first bridge portion is defined between the plurality of first eyelets, and the second bridge portion is defined between the plurality of second eyelets. Additionally, the footwear includes a second lace engaging both the first bridge portion and the second bridge portion to secure the first and second eyelet portions together.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figures 1, 2:
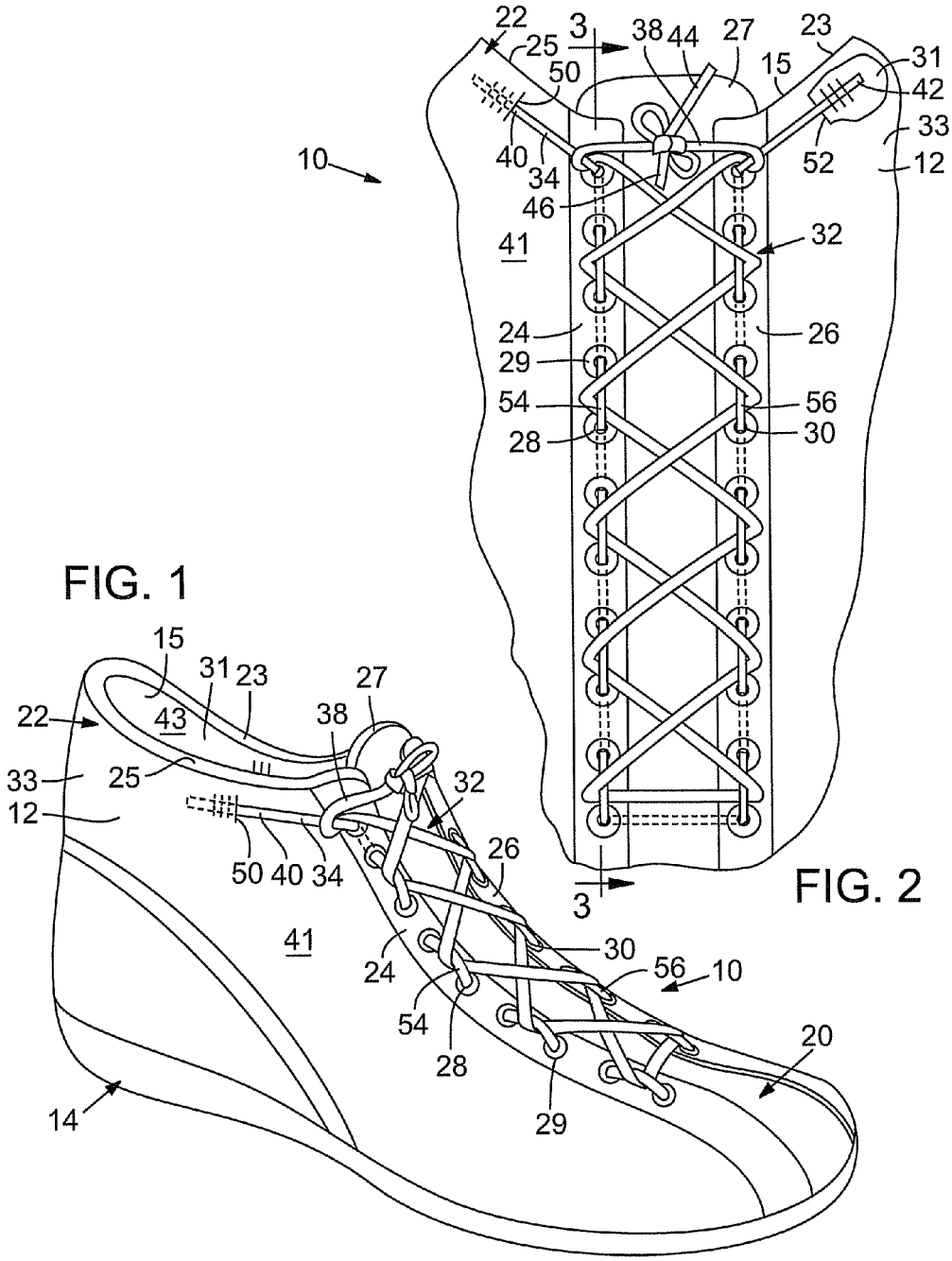
FIG. 1 is a perspective view of a closure system for an article of footwear according to various exemplary embodiments of the present disclosure.
FIG. 2 is a top view of the closure system of FIG. 1.
Figure 3:
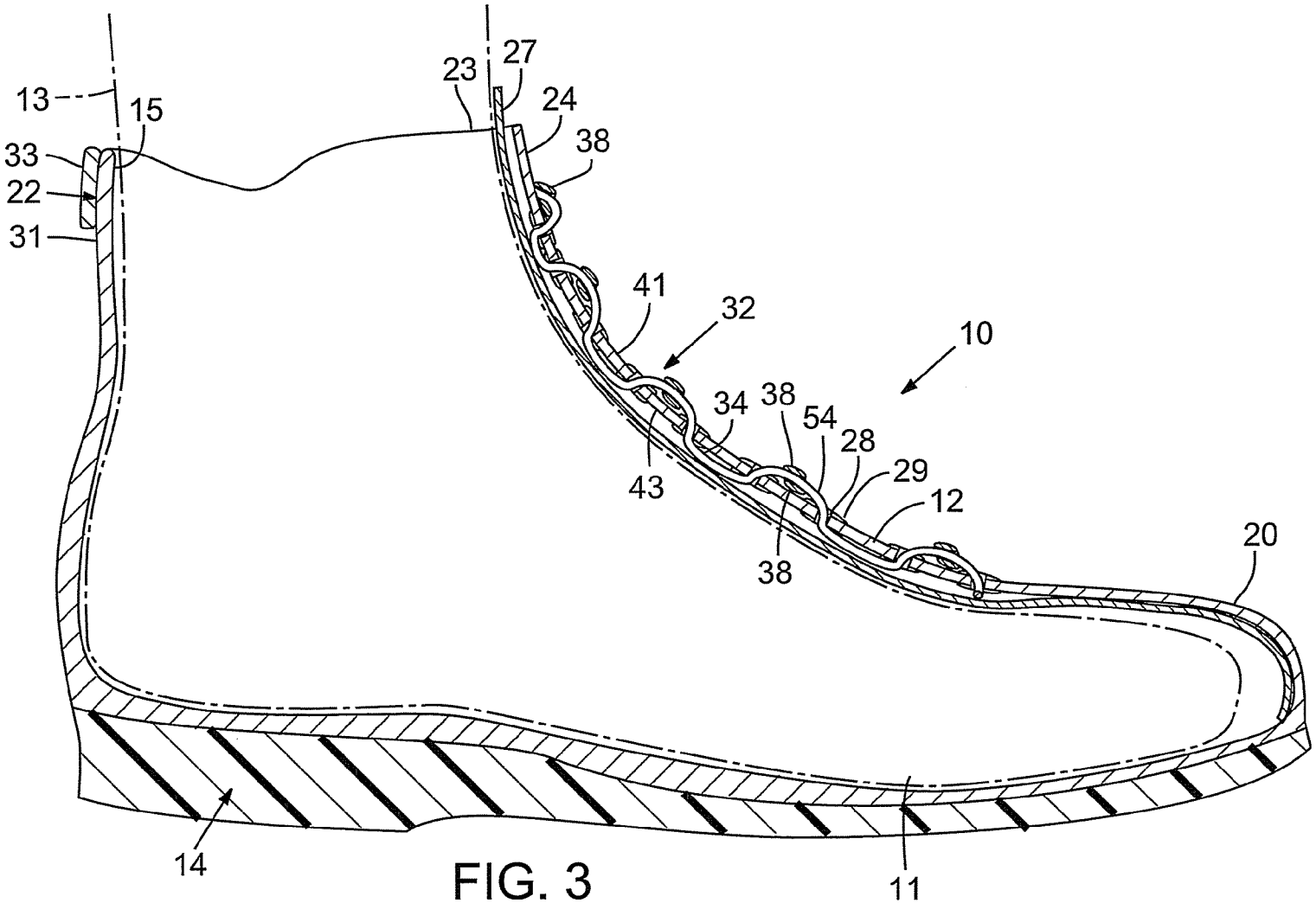
FIG. 3 is a sectional view of the closure system taken along line 3-3 of FIG. 2.

Referring to FIGS. 1-3, an article of footwear 10 is illustrated according to various exemplary embodiments of the present disclosure. The article of footwear 10 can fit about and support a foot 11 (FIG. 3) of a wearer. Although an athletic shoe is illustrated, it will be appreciated that the footwear 10 could be of any other type, such as a boot, a sandal, etc.

The article of footwear 10 can generally include an upper 12 and a sole assembly 14, which is operably coupled to the upper 12. The upper 12 can include one or more layers or panels of material (leather, fabric, etc.) that are interconnected so as to cover and wrap around the foot 11 of the wearer. The sole assembly 14 can include an outsole (not particularly shown), such as a layer rubber or other high-friction material for increasing traction of the footwear 10. The sole assembly 14 can also include a midsole (not particularly shown), such as a layer of foam, a fluid-filled bladder, or other resiliently flexible material for providing cushioned support for the foot 11.

Referring now to FIGS. 1 and 2, the upper 12 will be discussed in greater detail. Generally, the upper 12 can include an outer surface 41 and an inner surface 43. The inner surface 43 can face the foot 11, and the outer surface 41 can be opposite the inner surface 43.

As shown, the upper 12 can define a toe box 20 on an anterior and superior portion of the footwear 10. As shown in FIG. 3, the toe box 20 can cover the toes and, in some cases, the metatarsal area of the foot 11. The upper 12 can also define a collar portion 22. The collar portion 22 can be defined at a superior end of the footwear 10 and can define an opening 15 that receives the foot 11. For instance, the collar portion 22 can extend at least partially about a leg 13 of the wearer (FIG. 3). Specifically, the collar portion 22 can extend continuously between a medial side 21 and a lateral side 25. Thus, the medial side 21 can cover the medial side of the leg 13, and the lateral side 25 can cover the lateral side of the leg 13. The collar portion 22 can be disposed at any suitable location relative to the foot 11 and leg 13 of the wearer. For instance, the collar portion 22 can extend about the ankle, below the ankle, above the ankle, calf, or about any portion of the leg 13 of the wearer. In some embodiments, the collar portion 22 can be defined by an inner layer 31 and an outer layer 33 of the upper 12. The outer layer 33 can overlay the inner layer 31, and the inner layer 31 can be disposed between the outer layer 33 and the wearer's leg 13.

Still further, the upper 12 can include a first eyelet portion 24 that extends between the lateral side 25 of the collar portion 22 and the toe box 20. Similarly, the upper 12 can include a second eyelet portion 26 that extends between the medial side 23 of the collar portion 22 and the toe box 20. The first and second eyelet portions 24, 26 can be separate from each other and can be separated at a variable distance as will be discussed.

The upper 12 can also include a tongue 27. The tongue 27 can be fixed at one end to the toe box 20 and can extend toward the collar portion 22 to cover the space between the first and second eyelet portions 24, 26. The tongue 27 can be disposed between the first and second eyelet portions 24, 26 and the wearer's foot 11 (FIG. 3).

The first eyelet portion 24 can include a plurality of first eyelets 28, and the second eyelet portion 26 can include a plurality of second eyelets 30. Each eyelet 28, 30 can be a through-hole extending through the respective eyelet portion 24, 26. In some embodiments, each eyelet 28, 30 can be reinforced by a respective rigid, ring-shaped grommet 29. The first eyelets 28 can be substantially aligned in a row that extends between the toe box 20 and the collar portion 22. Likewise, the second eyelets 30 can be substantially aligned in a similar row. In other embodiments, the first and second eyelets 28, 30 can be misaligned and can be located anywhere on the footwear 10. Also, it will be appreciated that the footwear 10 can include any number of first and second eyelets 28, 30.

The article of footwear 10 can additionally include a closure system 32. As will be discussed, the closure system 32 can be used for selectively securing the first and second eyelet portions 24, 26 together to thereby secure the footwear 10 to the wearer's foot. Also, as will be discussed, the closure system 32 can distribute forces fairly evenly, such that the closure system 32 is unlikely to fail or break prematurely. Moreover, the closure system 32 can conform to the wearer's foot, without being too tight or too loose, such that the footwear 10 fits comfortably and securely to the foot.

As shown in FIGS. 1 and 2, the closure system 32 can include a first lace 34. The first lace 34 can be a flexible and elongate cord so as to include a first terminal end 40 and a second terminal end 42 (FIG. 2). In some embodiments, the first lace 34 can be resiliently flexible such that the length of the first lace 34 from the first terminal end 40 to the second terminal end 42 can be stretched and extended, and the first lace 34 can recover to its original, unbiased length. Also, the first lace 34 can be woven from a plurality of resiliently flexible fibers, or the first lace 34 can be a single, monolithic length of resiliently flexible cord. In other embodiments, the first lace 34 can be substantially inelastic such that the length of the first lace 34 from the first terminal end 40 to the second terminal end 42 does not change substantially under normal loading of the footwear 10. The first lace 34 can be a commercially available lace supplied from Paiho Group, with a head office at No. 575, Ho Kang Rd., Ho Mei Town, Changhua Hsien, Taiwan.

The closure system 32 can also include a second lace 38. The second lace 38 can be flexible and elongate so as to include a first terminal end 44 and a second terminal end 46 (FIG. 2). In some embodiments, the second lace 38 can be substantially inelastic such that the length of the second lace 38 from the first terminal end 44 to the second terminal end 46 does not change substantially under normal loading of the footwear 10. In other embodiments, the second lace 38 can be resiliently flexible. For instance, in some embodiments, in which the first lace 34 is substantially inelastic, the second lace 38 can be resiliently flexible. The second lace 34 can be a commercially available lace supplied from Paiho Group, with a head office at No. 575, Ho Kang Rd., Ho Mei Town, Changhua Hsien, Taiwan.

Referring to FIGS. 1-3, the first lace 34 can extend continuously through the plurality of first eyelets 28 and continuously through the plurality of second eyelets 30. For instance, in some embodiments, the first lace 34 can extend or thread through adjacent first eyelets 28 in sequence from the collar portion 22 to the toe box 20. Further along the axis of the first lace 34, the first lace 34 can also extend from the first eyelet 28 immediately adjacent (closest to) the toe box 20 to the second eyelet 30 immediately adjacent the toe box 20 so as to extend between the first and second eyelet portions 24, 26 of the upper 12. Still further along the axis of the first lace 34, the first lace 34 can extend or thread through adjacent second eyelets 30 in sequence from the toe box 20 to the collar portion 22 (FIG. 3).

Also, the first terminal end 40 of the first lace 34 can be operably secured to (e.g., fixed) to the collar portion upper 12. For instance, as shown in FIGS. 1 and 2, the outer layer 33 of the collar portion 22 can include a first opening 50 (e.g., a slit) located on the lateral side 25 thereof, and the outer layer 33 can include a second opening 52 (e.g., a slit) located on the medial side 23 as well. The first terminal end 40 can be received in the first opening 50 to be disposed between the inner and outer layers 31, 33 of the collar portion 22, and the second terminal end 42 can be received in the second opening 52 to be disposed between the inner and outer layers 31, 33. The first and second ends 40, 42 can each be fixed directly to the collar portion 22 of the upper 12 in any suitable fashion. For instance, in some embodiments, the first and second ends 40, 42 can be stitched to the upper 12, between the inner and outer layers 31, 33 of the collar portion 22. It will be appreciated, however, that the first and second ends 40, 42 can be disposed and/or attached anywhere on the footwear 10. For instance, the first and second ends 40, 42 can extend downward toward the sole assembly 14 (e.g., to be fixed adjacent the sole assembly 14).

As shown in FIGS. 1-3, the first lace 34 can extend through the first eyelets 28 in a manner so as to define a plurality of first bridge portions 54, and the first lace 34 can extend through the second eyelets 30 in a manner so as to define a plurality of second bridge portions 56. Specifically, as shown in FIG. 3, the first bridge portions 54 of the first lace 34 can be defined between immediately adjacent pairs of first eyelets 28. The first bridge portions 54 can alternate between overlaying the outer surface 41 and the inner surface 43 as shown in FIG. 3. As shown in FIG. 2, the second bridge portions 56 of the first lace 34 can be arranged in a substantially similar manner relative to the second eyelet portion 26.

Still further, the second lace 38 can engage at least one of the first and second bridge portions 54, 56 to secure the first and second eyelet portions 24, 26 together. For instance, as shown in FIG. 2, the second lace 38 can extend between the outer surface 41 of the upper 12 and the respective first bridge portion 54 to secure to the respective first bridge portion 54. Likewise, the second lace 38 can extend between the outer surface 41 of the upper 12 and the respective second bridge portion 56 to secure to the respective second bridge portion 56. The second lace 38 can alternatingly engage respective ones of the first and second bridge portions 54, 56 by criss-crossing over itself as the second lace 38 extends between the toe box 20 and the collar portion 22 of the footwear 10. For instance, the second lace 38 can engage successive alternating bridge portions 54, 56 as the second lace 38 extends between the toe box 20 and the collar portion 22. The first and second terminal ends 44, 46 of the second lace 38 can be pulled tight and tied in a knot, tied in a bow, or otherwise secured directly together adjacent the collar portion 22 as shown in FIGS. 1 and 2 to secure the closure system 32.

Thus, the footwear 10 can be secured to the foot 11 quickly and effectively using the closure system 32. Moreover, because of the resiliency of the first and/or second lace 34, 38, the footwear 10 can more easily conform to the foot 11 for better fit and comfort. This resiliency can allow the closure system 32 to be tight enough to secure the footwear 10 to the foot 11 and to also resiliently flex when necessary such that the footwear 10 is unlikely to fit overly tight on the foot 11. Also, loading (e.g., tension) within the laces 34, 38 can be substantially evenly distributed. As such, pressure points are unlikely to develop on the foot 11 for better comfort, and the laces 34, 38 are unlikely to prematurely break.

It will be appreciated that the laces 34, 38 can be secured together in various other ways other than those described herein or illustrated in FIGS. 1-3 without departing from the scope of the present disclosure. For instance, the second lace 38 can be secured between the inner surface 43 and the bridge portions 54, 56 to secure thereto. Also, the first lace 34 can extend through eyelets 28, 30 that are not immediately adjacent. Moreover, the second lace 38 can engage non-successive bridge portions 54, 56. Still further, first lace 34 can extend through any number of the eyelets 28, 30. Additionally, the second lace 38 can engage any number of bridge portions 54, 56.

Also, the first and second eyelet portions 24, 26 as well as the first and second eyelets 28, 30 could be disposed on any suitable portion of the footwear 10. Moreover, the footwear 10 can include any number of eyelets 28, 30.

Additionally, the closure system 32 could be included and used on an object other than an article of footwear 10. For instance, the closure system 32 could be used on a football, rugby ball, or other suitable piece of sporting equipment. Also, the closure system 32 can be employed on shirts, pants, or other articles of apparel, or the closure system 32 can be employed on bags or other accessories without departing from the scope of the present disclosure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An object comprising:

a body having a first portion and a second portion that are separate from each other, the first portion including a plurality of first eyelets, the second portion including a plurality of second eyelets;

a first lace that is resiliently stretchable between a first length and a second length, the first lace extending continuously through the plurality of first eyelets and continuously through the plurality of second eyelets, the first lace having a first bridge portion defined between a first pair of the first eyelets, the first lace also having a second bridge portion defined between a second pair of the second eyelets; and a second lace that is substantially inelastic to have a substantially fixed length, the second lace engaging both the first bridge portion and the second bridge portion to secure the first and second portions of the object together.

2. The object of claim 1, wherein the first lace defines a plurality of first bridge portions and a plurality of second bridge portions, and wherein the second lace extends between and engages plural ones of the first bridge portions and plural ones of the second bridge portions.

3. The object of claim 2, wherein the second lace alternatingly engages respective ones of the plurality of first bridge portions and respective ones of the plurality of second bridge portions.

4. The object of claim 1, wherein the body is an upper for an article of footwear including a collar portion that extends about a wearer, and wherein the first lace includes a terminal end that is fixed directly to the collar portion.

5. The object of claim 4, wherein the upper includes a medial side, a lateral side, and a heel region, wherein the collar portion extends between the medial side and the lateral side, wherein the collar portion extends across the heel region, wherein the first lace includes a first terminal end and a second terminal end, wherein the first terminal end and the second terminal end are each fixed directly to the collar portion, and wherein the first terminal end and the second terminal end are both directed toward the heel region.

6. The object of claim 4, wherein the collar portion includes an outer layer and an inner layer, wherein the outer layer includes an opening, and wherein the terminal end is received by the opening to extend between the inner and outer layer to be fixed directly to the collar portion.

7. An object comprising:

a body with an inner surface and an outer surface, the body also including a first portion and a second portion that are separate from each other, the first portion and the second portion both partially defining the inner surface and the outer surface, the first portion including a plurality of first eyelets that extend between the inner surface and the outer surface, the plurality of first eyelets arranged in a first row, the second portion including a plurality of second eyelets that extend between the inner surface and the outer surface, the plurality of second eyelets arranged in a second row;

a first lace extending continuously along the first row and through the plurality of first eyelets in sequence, the first lace also extending continuously along the second row and through the plurality of second eyelets in sequence, the first lace defining a first bridge portion and a second bridge portion, the first bridge portion defined between a first pair of adjacent ones of the plurality of first eyelets, the second bridge portion defined between a second pair of adjacent ones of the plurality of second eyelets; and a second lace that continuously extends between and engages the first bridge portion and the second bridge portion to secure the first and second portions of the object together.

8. The object of claim 7, wherein one of the first lace and the second lace is more resiliently stretchable in length than the other of the first lace and the second lace.

9. The object of claim 8, wherein the first lace is resiliently stretchable between a first length and a second length and the second lace is substantially inelastic to have a substantially fixed length.

10. The object of claim 7, wherein the first lace alternates between extending across the outer surface and extending across the inner surface as the first lace extends along the first row and through the plurality of first eyelets.

11. The object of claim 7, wherein the body is an upper of an article of footwear including a medial side, a lateral side, and a heel region, wherein the upper includes a collar portion that extends between the medial side and the lateral side, wherein the collar portion extends across the heel region, and wherein the first lace includes a terminal end that is fixed directly to the collar portion, and wherein the terminal end is directed toward the heel region.

12. The object of claim 11, wherein the collar portion includes an outer layer and an inner layer, wherein the outer layer includes an opening, and wherein the terminal end is received by the opening to extend between the inner and outer layer to be fixed directly to the collar portion.

13. The object of claim 7, wherein the body is an upper of an article of footwear, wherein the upper includes a medial side, a lateral side, and a throat opening defined between the medial side and the lateral side, and wherein the first lace extends across between the medial side and the lateral side and across the throat opening.

14. An article of footwear comprising:

an upper having a collar portion that extends about a wearer, the upper also including an inner surface and an outer surface, the upper further having a first portion and a second portion, the first portion and the second portion being separate from each other, the first portion including a first eyelet, a second eyelet, and a third eyelet that are arranged in a first row and that extend between the inner surface and the outer surface, the second portion including a fourth eyelet, a fifth eyelet, and a sixth eyelet that are arranged in a second row and that extend between the inner surface and the outer surface, a first lace having a first terminal end and a second terminal end, the first and second terminal ends each fixed to the collar portion, the first lace extending continuously through the first eyelet, the second eyelet, and the third eyelet in sequence, the first lace also extending continuously through the fourth eyelet, the fifth eyelet, and the sixth eyelet in sequence, the first lace defining a first bridge portion, a second bridge portion, a third bridge portion, and a fourth bridge portion, the first bridge portion defined between the first eyelet and the second eyelet, the first bridge portion extending across the outer surface of the upper, the second bridge portion defined between the second eyelet and the third eyelet, the second bridge portion extending across the inner surface of the upper, the third bridge portion defined between the fourth eyelet and the fifth eyelet, the third bridge portion extending across the outer surface of the upper, the fourth bridge portion defined between the fifth eyelet and the sixth eyelet, the fourth bridge portion extending across the inner surface of the upper; and a second lace engaging both the first bridge portion and the third bridge portion to secure the first and second portions of the upper together.

15. The article of footwear of claim 14, wherein the collar portion includes an outer layer and an inner layer, wherein the outer layer includes a first opening and a second opening, wherein the first terminal end is received by the first opening to extend between the inner and outer layer to be fixed directly to the collar portion, and wherein the second terminal end is received by the second opening to extend between the inner and outer layer to be fixed directly to the collar portion.

16. The article of footwear of claim 14, wherein the upper also includes a toe box, wherein the first lace extends across the toe box and extends across the inner surface as the first lace extends between the first row and the second row.

17. The article of footwear of claim 16, wherein the first bridge portion is one of a plurality of first exterior bridge portions that are arranged along the first row, and wherein the third bridge is one of a plurality of second exterior bridge portions that are arranged along the second row, and wherein the second lace alternatingly engages respective ones of the plurality of first exterior bridge portions and respective ones of the plurality of second exterior bridge portions.

18. The article of footwear of claim 14, wherein one of the first lace and the second lace is resiliently stretchable between a first length and a second length, and wherein the other of the first lace and the second lace is substantially inelastic to have a substantially fixed length.

19. The article of footwear of claim 18, wherein the first lace is resiliently stretchable and the second lace is substantially inelastic.

20. The article of footwear of claim 14, wherein the collar portion includes a medial side that covers a medial side of the wearer and a lateral side that covers a lateral side of the wearer, wherein the first terminal end is fixed to the medial side, and wherein the second terminal end is fixed to the lateral side.

21. The article of footwear of claim 14, wherein the first row is substantially straight, and wherein the second row is substantially straight.

22. The object of claim 7, wherein the first row is substantially straight, and wherein the second row is substantially straight.

23. The object of claim 7, wherein body is an upper for an article of footwear, wherein the first lace includes a first end that extends from the first bridge portion and that is fixed to the upper, wherein the second lace includes a second end, a third end, and a middle portion that extends between the second end and the third end, wherein the middle portion continuously extends between and engages the first bridge portion and the second bridge portion to secure the first and second portions of the object together, and wherein the second end extends from the middle portion, wherein the second end turns over and around the first end to be disposed between the first end and the upper, and wherein the second end is secured to the third end.

24. The object of claim 7, wherein the body is an upper for an article of footwear, wherein the upper includes a throat opening that is defined between the first portion and the second portion, and further comprising a tongue that is attached to the upper, wherein the tongue is disposed within the throat opening, wherein the tongue spans across the throat opening between the first portion and the second portion, and wherein the first row of first eyelets and the second row of second eyelets are disposed over the tongue.

* * * * *